US007828461B2

(12) United States Patent
Mayer et al.

(10) Patent No.: US 7,828,461 B2
(45) Date of Patent: Nov. 9, 2010

(54) LED LUMINAIRE FOR GENERATING SUBSTANTIALLY UNIFORM ILLUMINATION ON A TARGET PLANE

(75) Inventors: Mark J. Mayer, Sagamore Hills, OH (US); Matthew Mrakovich, Streetsborough, OH (US); Nicolo Machi, Solon, OH (US)

(73) Assignee: Lumination LLC, Valley View, OH (US)

( * ) Notice: Subject to any disclaimer, the term of this patent is extended or adjusted under 35 U.S.C. 154(b) by 223 days.

(21) Appl. No.: 12/021,262

(22) Filed: Jan. 28, 2008

(65) Prior Publication Data

US 2009/0021933 A1 Jan. 22, 2009

Related U.S. Application Data

(63) Continuation-in-part of application No. 11/778,502, filed on Jul. 16, 2007.

(51) Int. Cl.
*F21V 7/00* (2006.01)

(52) U.S. Cl. ..... 362/241; 362/247; 362/297; 362/304

(58) Field of Classification Search ..... 362/235, 362/241, 243, 245, 247, 297, 304, 305, 296.05–296.08
See application file for complete search history.

(56) References Cited

U.S. PATENT DOCUMENTS

| | | | | |
|---|---|---|---|---|
| 5,642,933 | A | 7/1997 | Hitora | |
| 5,929,788 | A * | 7/1999 | Vukosic | 340/908.1 |
| 6,163,100 | A * | 12/2000 | Morizaki et al. | 310/317 |
| 6,679,618 | B1 * | 1/2004 | Suckow et al. | 362/247 |
| 2003/0193807 | A1 | 10/2003 | Rizkin et al. | |
| 2006/0198141 | A1 | 9/2006 | Peck et al. | |
| 2006/0198148 | A1 | 9/2006 | Peck | |
| 2006/0209541 | A1 | 9/2006 | Peck | |
| 2007/0002572 | A1 * | 1/2007 | Ewig et al. | 362/470 |

* cited by examiner

*Primary Examiner*—Bao Q Truong
(74) *Attorney, Agent, or Firm*—Fay Sharpe LLP

(57) ABSTRACT

A luminaire that can provide a beam pattern having a substantially uniform illuminance across a target plane includes a plurality of LEDs mounted on a support and at least one reflector fixed with respect to the support and cooperating with the plurality of LEDs.

29 Claims, 14 Drawing Sheets

LED LUMINAIRE FOR GENERATING SUBSTANTIALLY UNIFORM ILLUMINATION ON A TARGET PLANE

CROSS-REFERENCE TO RELATED PATENTS AND APPLICATIONS

This is a continuation-in-part application of co-pending U.S. Utility patent application Ser. No. 11/778,502, filed Jul. 16, 2007 and entitled "LED LUMINAIRE FOR GENERATING SUBSTANTIALLY UNIFORM ILLUMINATION ON A TARGET PLANE," the entirety of which is incorporated herein by reference.

BACKGROUND

When illuminating a parking lot, a street or even the inside of a building, it is oftentimes desirable to provide generally uniform illumination over the target area. Designers of parking lots, streets and buildings typically specify a minimum illuminance (lumens per square foot or meter) required throughout the target area. The illuminance at locations on the target area that exceeds the specified minimum can be considered as wasted illuminance. It is desirable to redirect the light that would have been directed toward areas that exceed the minimum illuminance to reduce the amount of energy required to illuminate the entire target area.

Illumination is inversely proportional to the square of the distance between the point light source and a point on the surface that is to be illuminated, i.e. the target area. Because of this law, a light fixture placed x distance (feet or meters) above a planar target area will require eight times the luminous intensity in a direction that is offset 60° from the vertical axis as compared to the light output in the vertical axis in order to provide the same illuminance at each location on the plane. Known light sources, incandescent and arc type lamps, account for this by designing a reflector that directs more light toward the periphery of the target area. This design can be accomplished by assuming that the incandescent or arc type light source is a point light source and then appropriately shaping the reflector to accommodate this point light source.

Light emitting diodes ("LEDs"), on the other hand, are typically not powerful enough so that a single LED, which could act as the point light source similar to the incandescent and arc type lamps, provides sufficient illumination over a large target area. This is especially the case where the LED is positioned several feet or meters above the target area. Moreover, LEDs typically do not emit light in a spherical pattern, such as incandescent and arc-type lamps, thus making it difficult to design an appropriate reflector.

To provide sufficient illumination for the target area multiple LEDs can be required to provide the sufficient amount of lumens to provide the minimum illuminance to meet the project specifications for the target area. LEDs are typically mounted on a printed circuit board ("PCB") and when a sufficient amount of LEDs are provided on the PCB, however, the size of the PCB required and the number of LEDs required makes it difficult to consider the plurality of LEDs in aggregate as a single point light source. In view of this, it has been known to provide separate optics, either refractive of reflective, for each LED to redirect the light emanating from each LED. Providing a separate optic for each LED can be expensive and also make design of the fixture difficult, especially where it is desirable to provide a light fixture that is easily scalable so that it can be used in a number of different applications. Additionally, the number of LEDs that are required to meet illuminance specifications and the spacing required between adjacent LEDs can result in a very large light fixture.

SUMMARY

A luminaire that can provide a beam pattern having a substantially uniform illuminance across a target plane includes a first plurality of LEDs mounted on a support facing a target plane, a second plurality of LEDs mounted on the support facing the target plane and at least one reflector fixed with respect to the support. Respective centers of the first LEDs are each spaced substantially equidistantly from a fixed point a distance d1. The at least one reflector includes a first reflective surface of revolution with respect to a line intersecting the fixed point that cooperates with each of the first LEDs and a second reflective surface of revolution with respect to the line intersecting the fixed point that cooperates with each of the second LEDs. The reflective surfaces are configured to direct light emitted from the respective LEDs toward the target plane.

A luminaire that can provide a beam pattern having a substantially constant illuminance across a target plane can also include a substantially planar PCB, a first set of LEDs mounted on the PCB along an arc of a first circle having a radius r1, a second set of LEDs mounted on the PCB along an arc of a second circle having a radius r2, and at least one reflector fixed with respect to the PCB. The first circle is concentric with the second circle about a center point and r1>r2. The at least one reflector includes a first reflective surface cooperating with each of the first set of LEDs and a second reflective surface cooperating with each of the second set of LEDs. Each of the reflective surfaces is a surface of revolution with respect to an axis intersecting the center point and normal to the PCB.

Another example of a luminaire includes a first set of LEDs, a first reflective surface cooperating with the first set of LEDs, a second set of LEDs and a second reflective surface cooperating with the second set of LEDs. The first reflective surface and the first set of LEDs cooperate to direct light from the first set of LEDs to form a first generally annular beam pattern on a target plane, where a peak of luminous intensity of light from the first set of LEDs is at a first angle of incidence. The second reflective surface cooperates with the second set of LEDs to direct light from the second set of LEDs to form a second generally annular beam pattern on the target plane, where a peak of luminous intensity of light from the second set of LEDs is at a second angle of incidence. The first angle of incidence is greater than the second angle of incidence. The second angle of incidence is a function of overlap of the first generally annular beam pattern on the second annular beam pattern and a height at which the LEDs reside over the target plane. The luminaire generates a combined beam pattern including the first generally annular beam pattern and the second generally annular beam pattern having a generally uniform illumination across at least a majority of a combined beam pattern on the target plane.

DETAILED DESCRIPTION

Figure 1:
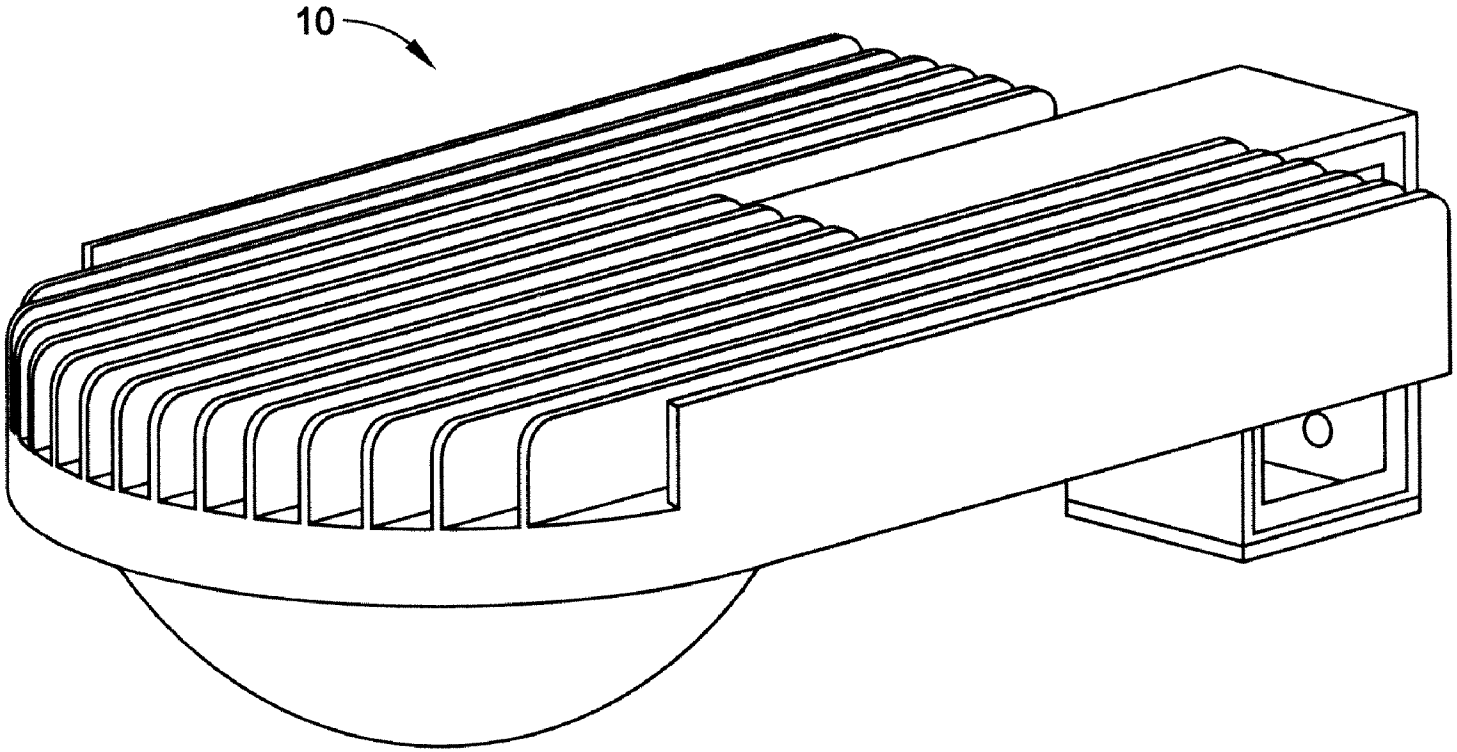
FIG. 1 is a perspective view of a first (upper) side of a luminaire that generates substantially uniform illumination across a target surface.
Figure 2:
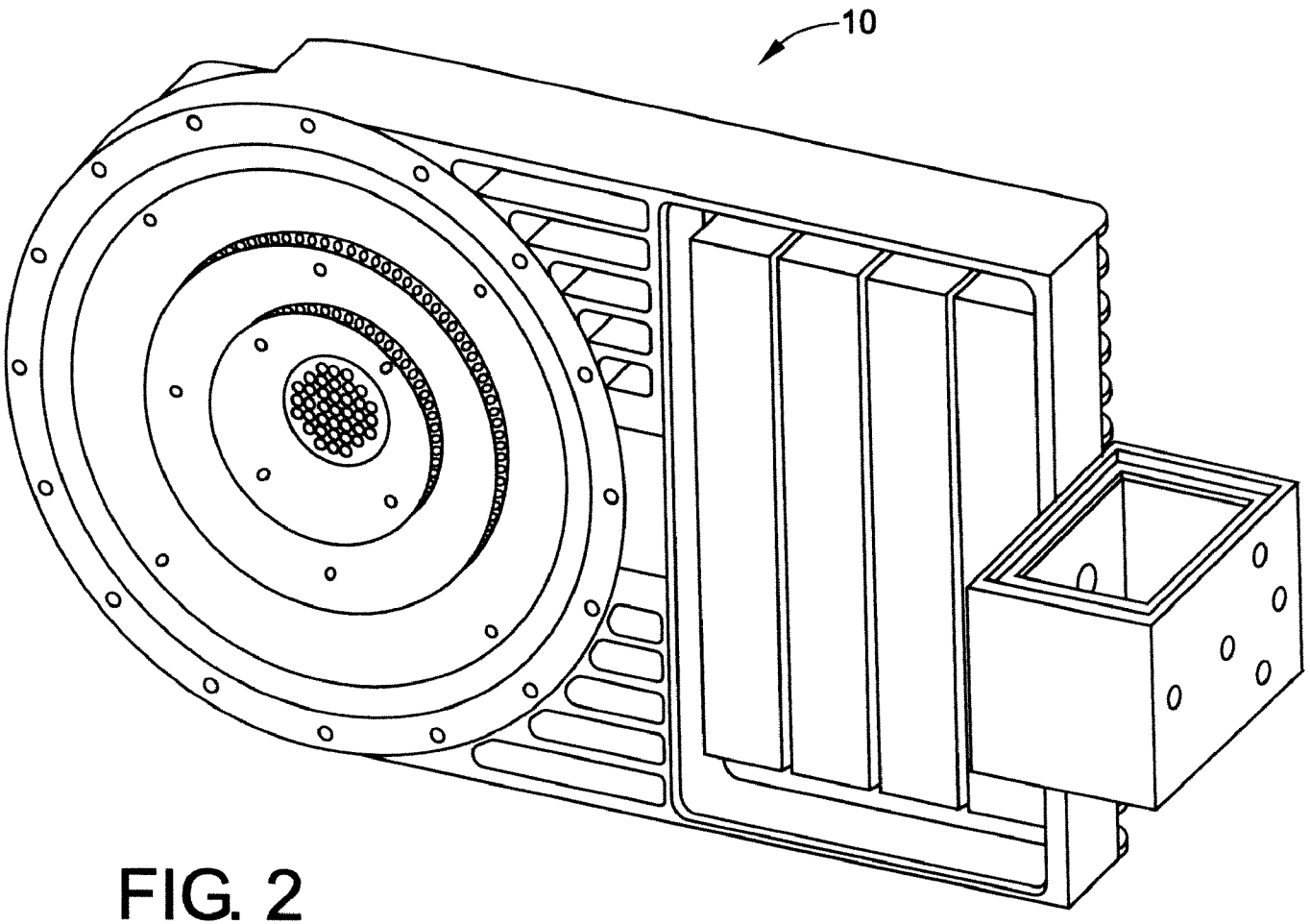
FIG. 2 is a perspective view of a second (lower) side of the luminaire of FIG. 1.
Figure 3:
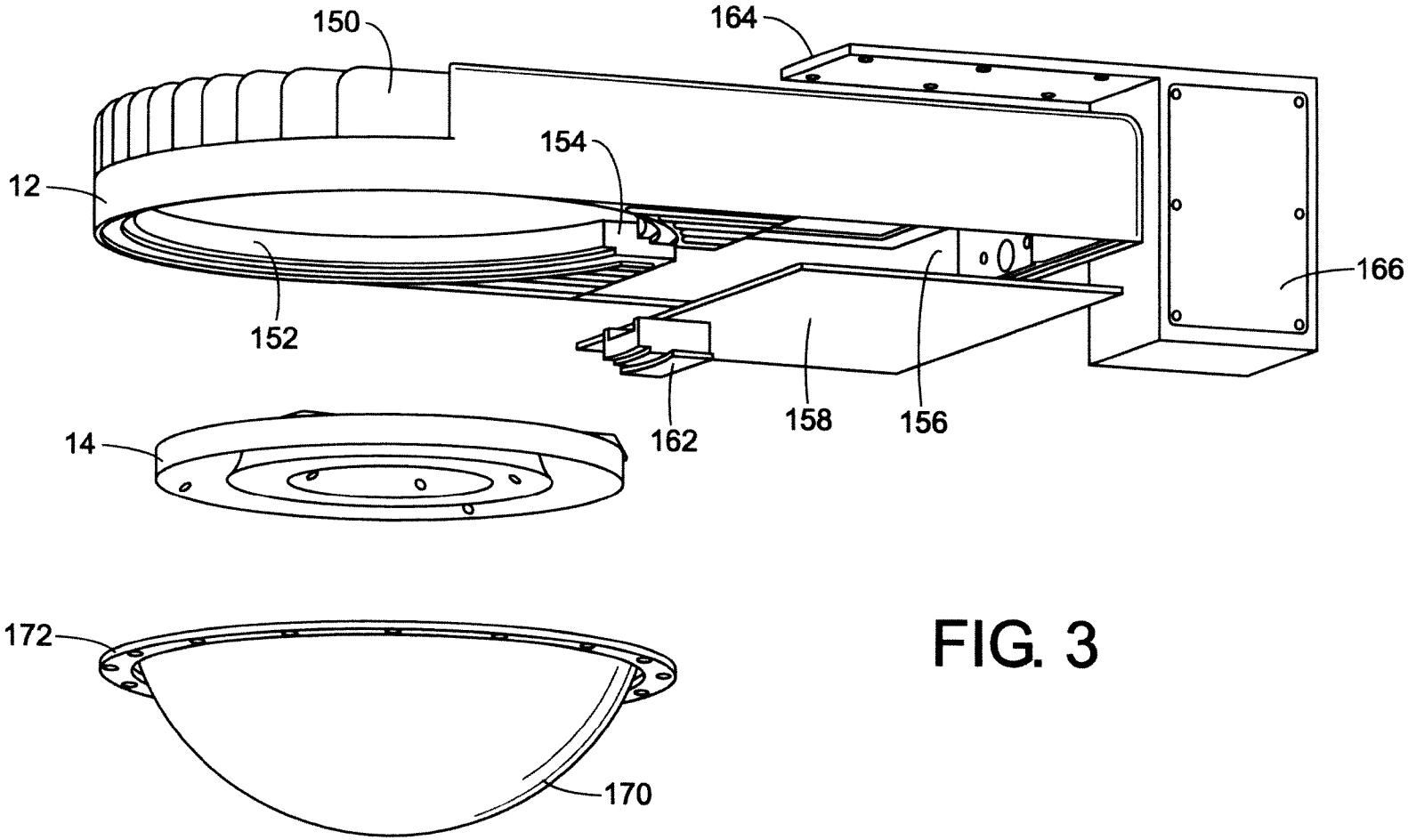
FIG. 3 is an exploded view of the luminaire of FIG. 1.
Figure 4:
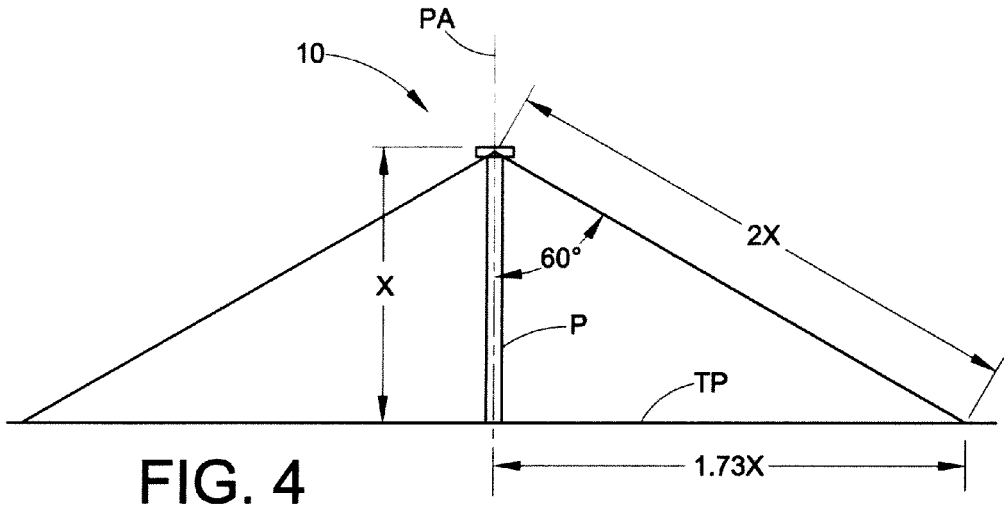
FIG. 4 is a schematic depiction of the luminaire of FIG. 1 mounted to a light pole and illuminating a target plane.

With reference to FIGS. 1 and 2, an example of a luminaire 10 that is capable of providing uniform illumination across a target surface, or target plane, is shown. With reference to FIG. 3, the luminaire includes, among other components, a fixture housing 12 and a reflector/PCB assembly 14 that mounts to the fixture housing. With reference to FIG. 4, the luminaire 10 is configured to mount to a light pole P and illuminate a target plane TP, which can make up a portion of a parking lot, a street, a pathway, a building floor, a field, etc. Similar to a conventional luminaire that is used to illuminate a target plane, the area that is illuminated by the luminaire 10 of the present embodiment is circular in plan view. Alterations can be made to change the illumination pattern.

With reference to FIG. 4, the luminaire 10 (depicted schematically) mounts to a light pole P and the light pole defines a vertical axis, which will be referred to as the pole axis PA. The luminaire 10 could also mount below the target plane, e.g. the target plane could be a ceiling. In such an instance, or where no pole is provided, the vertical axis is the axis that is centered on the light source of the luminaire 10 and is normal to the target plane TP. Since, as mentioned above, illumination is inversely proportional to the square of the distance between a point light source and the surface to be illuminated the luminous intensity from the point light source in the angular direction 60° offset from the pole axis PA must be eight times the lumen output in the vertical direction to provide the same illumination on the target plane at a location directly beneath the light source as at the location on the target plane that is offset 60° from the light pole. Where the luminaire 10 is a great enough distance above (or below) the target plane TP, it can be assumed to act as a point light source. The luminaire 10 is configured to provide greater luminous intensity output away from the vertical axis, i.e. the pole axis PA, to provide more uniform illumination across the target plane TP.

Figure 5:
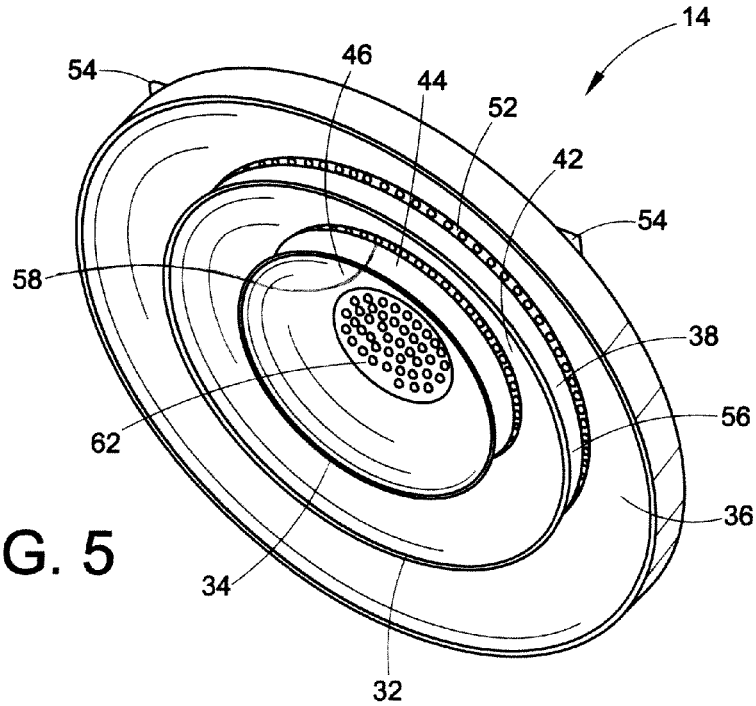
FIG. 5 is a perspective view of a reflector/PCB assembly found in the luminaire of FIG. 1.

With reference to FIG. 5, the reflector/PCB assembly 14 in the depicted embodiment includes an outer reflector 30, an intermediate reflector 32, and an inner reflector 34. The reflectors 30, 32, and 34 can be three separate components, formed as an integral piece or two adjacent reflectors can be formed as an integral piece and the remaining reflector can be a separate piece. The outer reflector 30 forms a first reflective surface 36. The intermediate reflector 32 forms a second reflective surface 38 and a third reflective surface 42. The inner reflector 34 forms a fourth reflective surface 44 and a fifth reflective surface 46. A fewer or a greater number of reflectors and reflective surfaces can be provided.

The reflector/PCB assembly 14 in the depicted embodiment also includes LEDs mounted to a mounting surface 52 of a PCB 54. In the depicted embodiment the LEDs all face toward the target plane TP (FIG. 4, i.e. downward in the example shown in FIG. 4) to direct light generally towards the target plane. The LEDs mount to the mounting surface 52, which is planar, of the PCB 54 so that an outer set 56 of LEDs have their centers disposed along a line, an intermediate set 58 have their centers positioned along a line, and an inner set 62 are formed in an array. More particular to the depicted embodiment, the outer LED set 56 forms a ring, or circle, and cooperates with the first reflective surface 36 and the second reflective surface 38. The intermediate LED set 58 forms a ring, or circle, and cooperates with the third reflective surface 42 and the fourth reflective surface 44. The inner LED set 62 cooperates with the fifth reflective surface 46.

The LED sets 56, 58 and 62 can also be positioned to form other patterns, especially where the reflectors may take a configuration other than circular. For example, where the reflectors may take a polygonal configuration, the LEDs can take the same polygonal configuration. This may be the case where the polygonal configuration has a regular polygon configuration with a large number of sides so that the polygon begins to approximate the dimensions of an inscribed circle of the polygon.

Figure 6:
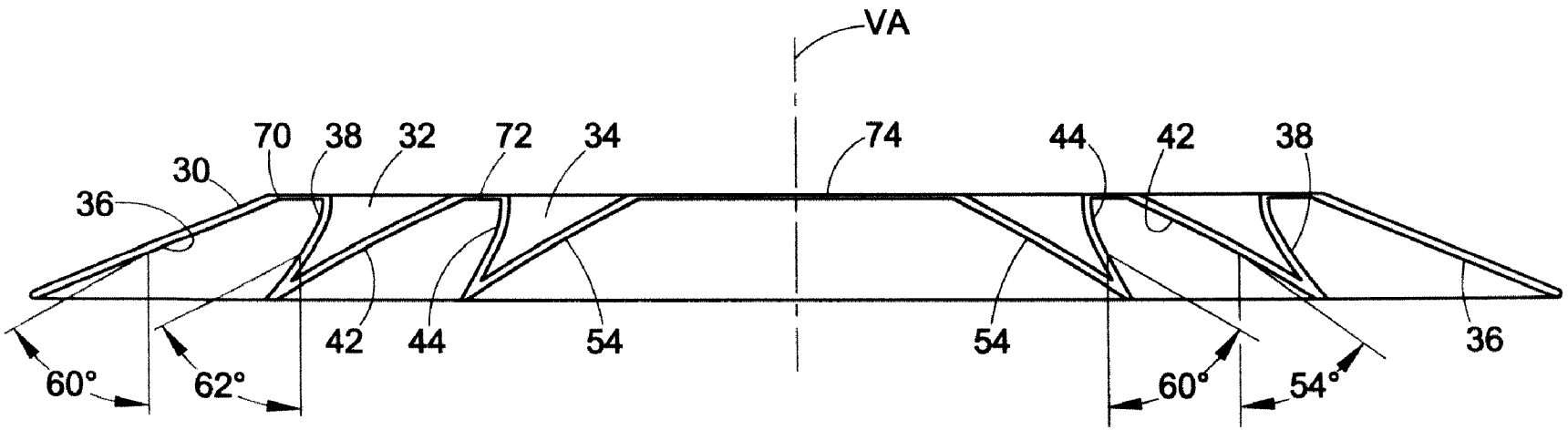
FIG. 6 is a cross-sectional view of reflectors of the reflector/PCB assembly.

As more clearly seen in FIG. 6, the outer reflector 30 and the intermediate reflector 32 define an outermost aperture 70 disposed between these reflectors. In a depicted embodiment, the outermost aperture 70 is circular so that the outer set 56 of LEDs are disposed in this aperture 70. Similarly, the intermediate reflector 32 is spaced from the inner reflector 34 to define an intermediate circular aperture 72 that receives the intermediate LED set 58. The inner 34 reflector includes a circular opening 74 to receive the inner LED set 62. The apertures 70, 72 and 74 are concentric about the vertical axis VA of the luminaire 10. As more clearly seen in FIG. 6, the second reflective surface 38 and the third reflective surface 42 share a common edge and the fourth reflective surface 44 and the fifth reflective surface 54 also share a common edge.

The outer LED set 56 is disposed on the PCB 54 so that their centers form a circle that is concentric about a central axis VA of the luminaire 10, which is parallel with the pole axis PA when the luminaire is mounted to a pole (see FIG. 4). Likewise the intermediate LED set 58 is disposed on the PCB 54 so that their centers form a circle that is concentric about a central axis VA of the luminaire. The reflective surfaces 36, 38, 42, 44 and 46 are each formed having an axis of revolution that is concentric with the central axis VA of the luminaire 10.

The outer LED set 56 and the first and second reflective surfaces 36, 38 are configured and positioned with respect to one another to direct light toward an area of the target plane TP that is angularly offset from the pole axis PA. The angular offset is the internal angle measured between the vertical axis VA of the luminaire, which is typically parallel to the pole axis PA, and the angle at which light is reflected from a respective reflective surface. More particularly, since eight times the lumen output is required to illuminate the area of the target plane that is angularly offset 60° from the pole axis PA as compared to the area of the target plane directly beneath the luminaire 10, the first reflector surface 36 and the second reflector surface 38 have a conic section configuration (more specifically a parabolic configuration in a cross section taken normal to the line on which the outer LED set 56 resides—see FIG. 6) that is configured to direct light that reflects off of the first and second reflective surfaces at about 60° (e.g. about 50° to about 70°, and more preferably about 55° to about 65°) from vertical. More particularly, the first reflective surface 36 and the second reflective surface 38 direct light in a substantially identical angular direction toward an area on the associated target surface. For example, in the embodiment depicted the first reflective surface 36 is configured to direct light at about 60° from vertical and the second reflective surface 38 is configured to direct light at about 62° from vertical. Accordingly, the first reflective surface 36 and the second reflective surface 38 direct light in a substantially identical angular direction. The differences between the direction at which the first reflector is configured to direct light and the direction at which the second reflector is configured to direct light is a function of how closely the intensity at the target plane matches the "perfect distribution" intensity, which will be discussed in more detail below (see FIG. 8).

Likewise, the intermediate LED set 58 and the third and fourth reflective surfaces 42, 44 are configured and positioned with respect to one another to direct light toward an area of the target plane TP that is angularly offset from the pole axis PA. The third reflector surface 42 and the fourth reflector surface 44 have a conic section configuration (more specifically a parabolic configuration in a cross section taken normal to the line on which the intermediate LED set 58 resides—see FIG. 6) that is configured to direct light that reflects off of the third and fourth reflective surfaces at about 60° (e.g. about 50° to about 70°) from vertical. For example, in the embodiment depicted the third reflective surface 42 is configured to direct light at about 54° from vertical and the fourth reflective surface 44 is configured to direct light at about 60° from vertical. Accordingly, the third reflective surface 42 and the fourth reflective surface 44 direct light in a substantially identical angular direction. The differences between the direction at which the third reflector is configured to direct light and the direction at which the fourth reflector is configured to direct light is a function of how closely the intensity at the target plane matches the "perfect distribution" intensity, which will be discussed in more detail below (see FIG. 8).

Accordingly, the outer LED set 56 and the intermediate LED set 58 can illuminate, generally, the same portion of the target plane. If desired, however, the shape of the reflectors can be altered so that the first LED set 56 illuminates a first portion or swath of the target plane and the second LED set 58 illuminates a second portion or swath of the target plane. Moreover, the shape of the individual reflectors can be altered to direct light where it is most needed to provide the most uniform illumination over the entire target plane.

Figure 8:
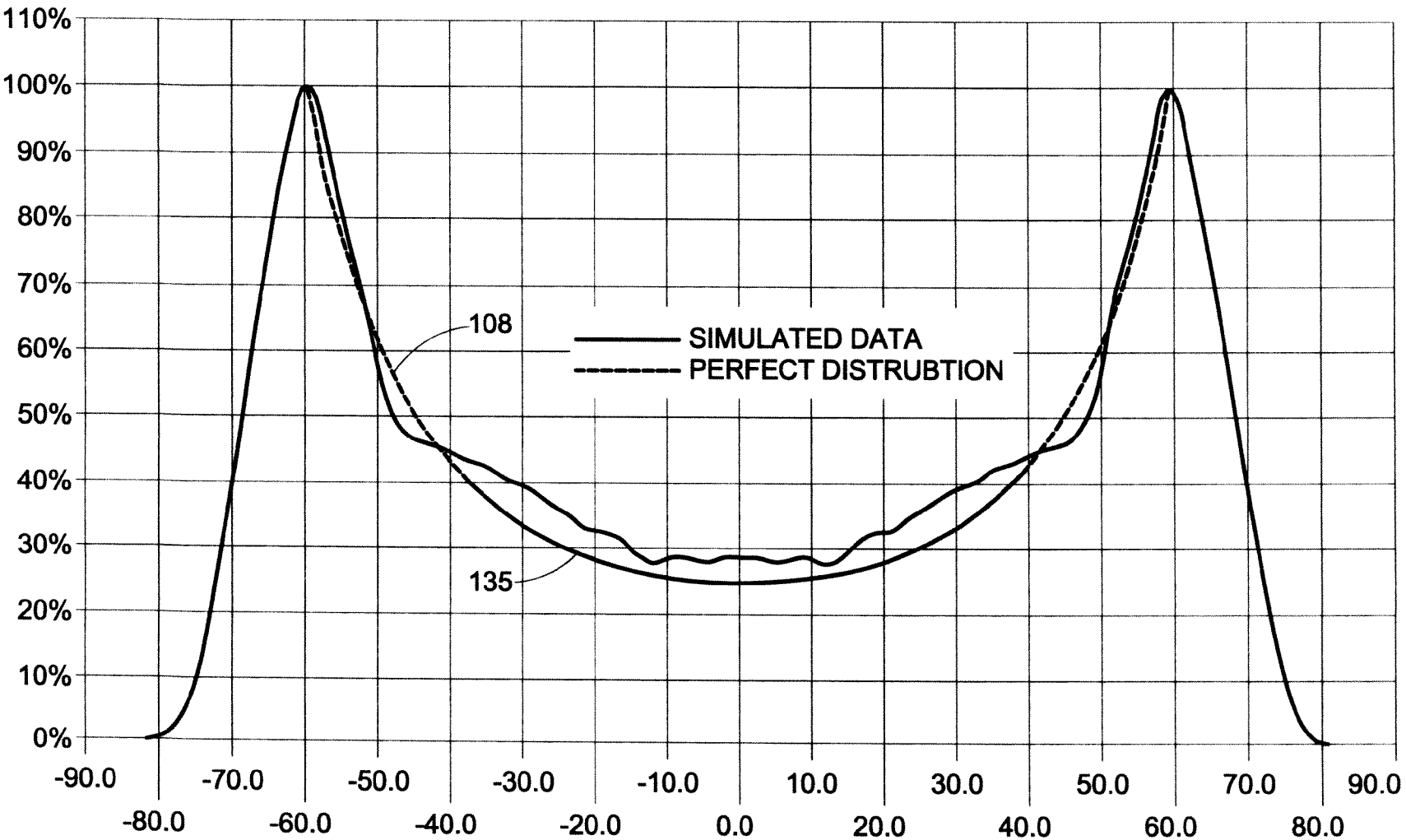
FIG. 8 is a graph showing a theoretical perfect luminous intensity at different angles with respect to a vertical axis and simulated data of luminous intensity at different angles with respect to a vertical axis for the luminaire shown in FIG. 1.

The inner LED set 62, which is in the form of an array and centrally disposed on the mounting surface 52 of the PCB 54, along with the fifth reflective surface 46, direct light to illuminate the central area of the target plane TP, i.e. the circular area of the target plane between the 60° offset location of the target plane and the pole axis PA. Much of the target plane that is illuminated between the portion of the target plane that offset 60° to the left in FIG. 4 and the portion of the target plane that is offset 60° to the right in FIG. 4 is illuminated by the third LED set 62 and this light is not reflected by a reflector of the luminaire. The fifth reflective surface 54 is used to direct light to more closely match "perfect distribution" intensity, which is shown in FIG. 8.

The design of the luminaire is scalable. If more light intensity is needed at the target plane TP, more LEDs (or higher powered LEDs) can be added to the luminaire 10. By using the reflectors and situating the LEDs in rings, or lines, around the central LED array, i.e. the central LED set 62 in the depicted embodiment, the additional rings or lines of LEDs can be used to illuminate the portion of the target plane that requires a greater lumen output to maintain uniform illuminance across the target plane. If more light intensity is needed at the outer edges of the target plane, then additional LED rings, e.g. in addition to the outer LED set 56 and the intermediate LED set 58, and additional reflectors can be added to the luminaire 10.

In addition to being scalable, the luminaire 10 can also be designed to provide a beam pattern that is a shape other than circular. For example, the reflector/PCB assembly 14 can be cut in half, e.g. at the axis VA in FIG. 6, to provide a semicircular shaped beam pattern. The reflectors can also take alternative configurations to provide a rectangular or square shaped beam pattern. Generally, ¼ of the light output flux from the luminaire is directed towards the center of the target plane as compared to the light output flux that is directed toward the periphery of the target plane, which provides four times the light output at a location on the target plane that is angularly offset 60° from vertical.

Figure 7:
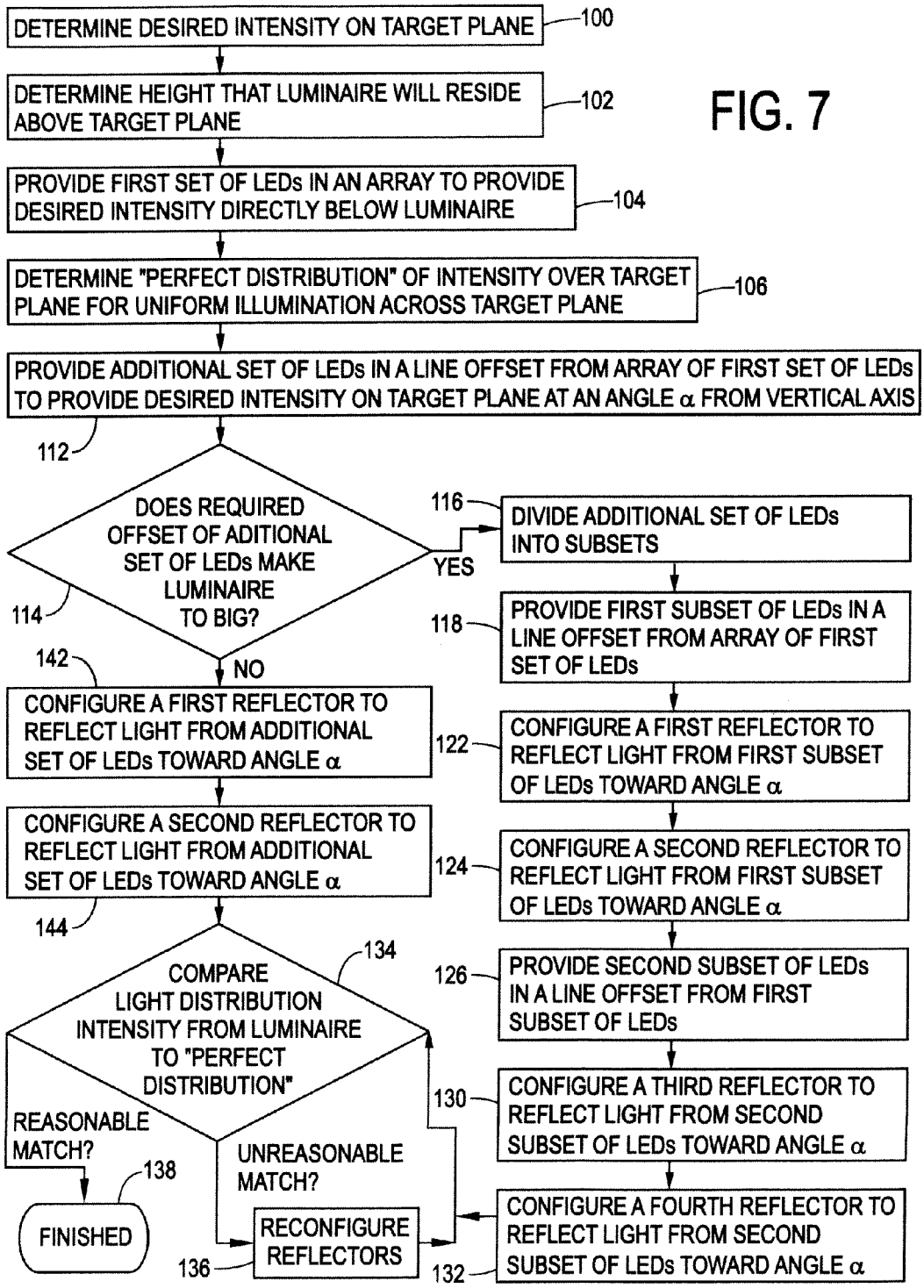
FIG. 7 is a flow chart showing an example of a method that can be used to design the luminaire shown in FIG. 1.

With reference to FIG. 7, the luminaire 10 can be designed in the following manner. At step 100, the desired illuminance threshold for the target plane TP is determined, which is typically equal to a minimum illuminance (lumens per square foot or meter) required by the design. At step 102, the height x that the luminaire 10 will reside above the target plane TP is then determined. This can often be a function of the minimum or maximum pole height allowed for a parking lot application or the ceiling height if the luminaire is located in a building. At step 104, the number (and power) of LEDs required to provide the desired intensity threshold at a location directly below (or above) the luminaire is determined. These LEDs can coincide with the central LED set 62 shown in FIG. 5. Since the height x will typically greatly exceed the plan dimensions of the array for the central LED set 62, the central LED set (as well as all the LEDs for the luminaire 10) can be assumed to act as a point light source.

At step 106, the "perfect distribution" of intensity over the target plane TP for uniform illumination across the target plane is determined. With reference to FIG. 8, "perfect distribution" is shown as line 108 where relative intensity is plotted in the vertical axis and the angular offset is depicted in the horizontal axis. The "perfect distribution" is determined using the relationship of the cosine of the internal angle between the pole axis and the direction at which light is emitted from the luminaire and the fact that illumination is inversely proportional to the square of the distance between a point light source and the surface to be illuminated. Since uniform illumination is desired across the target plane, the luminous flux generated at a particular angle can be determined.

With reference back to FIG. 7, at step 112, an additional set of LEDs, which coincides with either outer LED set 56 or the intermediate LED set 58, is provided in a line offset from the LED array, e.g. the central LED set 62, to provide a desired intensity on the target plane at an angle $\alpha$ from the vertical axis. At step 114, it is determined whether the required offset of the additional LEDs in the line, which would typically be formed in a circle, would make the luminaire 10 too big. If the luminaire would be too big or the offset be too great, then at step 116 the additional sets of LEDs are broken into subsets, which can coincide with the outer LED set 56 and the intermediate LED set 58.

Where multiple LED sets are required, at step 118, the first subset of LEDs can be provided in a line offset from the array (the outer LED set 56 can be positioned away from the central LED set 62). At step 122, a first reflector is configured to reflect the light from the first subset of LEDs (which coincides with the outer LED set 56) (FIG. 5) toward the angle α°. To reflect light toward the angle α°, the reflector is provided having a conic shape where the line in which the first subset of LEDs is located on the focus of the conic section to provide a collimated beam pattern directed in the direction of angle α°. To provide a more easily manufactured reflector, the reflector can then be cut or truncated so that the reflector follows only a portion of this conic section, which still allows the reflector to direct light towards the angle α°. As more clearly seen in FIG. 6, each reflective surface is truncated in a plane that is parallel to the mounting surface 54 of the PCB 56. The conic section, e.g. parabola is tilted with respect to the vertical axis VA so that light that contacts in the reflective surface is directed towards the angular direction α°.

At step 124, a second reflector is configured to reflect light from the first subset of LEDs toward α°. In other words, with reference back to FIG. 6, the first reflective surface 36 can be configured to direct light generally 60° offset from vertical and the second reflective surface 38 is configured to direct light generally 62° from vertical. Both of the reflective surfaces 36 and 38, as well as reflective surfaces 42 and 44, generally follow a conic section where the conic (which in this case is a parabola) has its symmetrical axis tilted toward the direction in which it is desired to direct light, e.g. about 60° from the vertical axis. Again, this conic shaped reflector can also be cut or truncated.

At step 126, a second subset of LEDs (which can also be placed in a ring around the first subset as well as the central array) is provided in a line offset from the first subset of LEDs. For example, with reference to FIG. 5, the central LED set 58 is disposed inside the outer LED set 56 and each are formed in a circle that is concentric about a symmetrical axis of the luminaire.

At step 130, a third reflector is configured to direct light from the second subset of LEDs toward α° and at step 132 a fourth reflector is configured to reflect light from this second subset of LEDs towards α°. For example, with reference back to FIG. 6, the reflective surfaces 36, 38, 42 and 44 are each configured to direct light from a respective ring of LEDs generally towards a direction that is 60° offset from vertical.

Light distribution from this luminaire is then compared to the perfect distribution at step 134. For example, simulated data, which can be derived using known computer modeling programs, is shown at line 135 in FIG. 8 that closely matches the perfect distribution. If the luminaire is designed such that there is not a reasonable match between the simulated data and the perfect distribution, then at step 136 the reflectors can be reconfigured in an effort to more closely match a perfect distribution. The light distribution can then be modeled again and compared at step 134. If a reasonable match occurs then at step 138 the luminaire design is finished.

With reference back to step 114, if the required offset or additional LEDs do not make the luminaire too big, then at step 142 a first reflector is configured for the additional set of LEDs. The design of this reflector is similar to the step 118 described above. Additionally, at step 144 a second reflector is configured to reflect light from the additional set of LEDs toward α° and then this design luminaire is compared to the perfect distribution.

Figure 9:
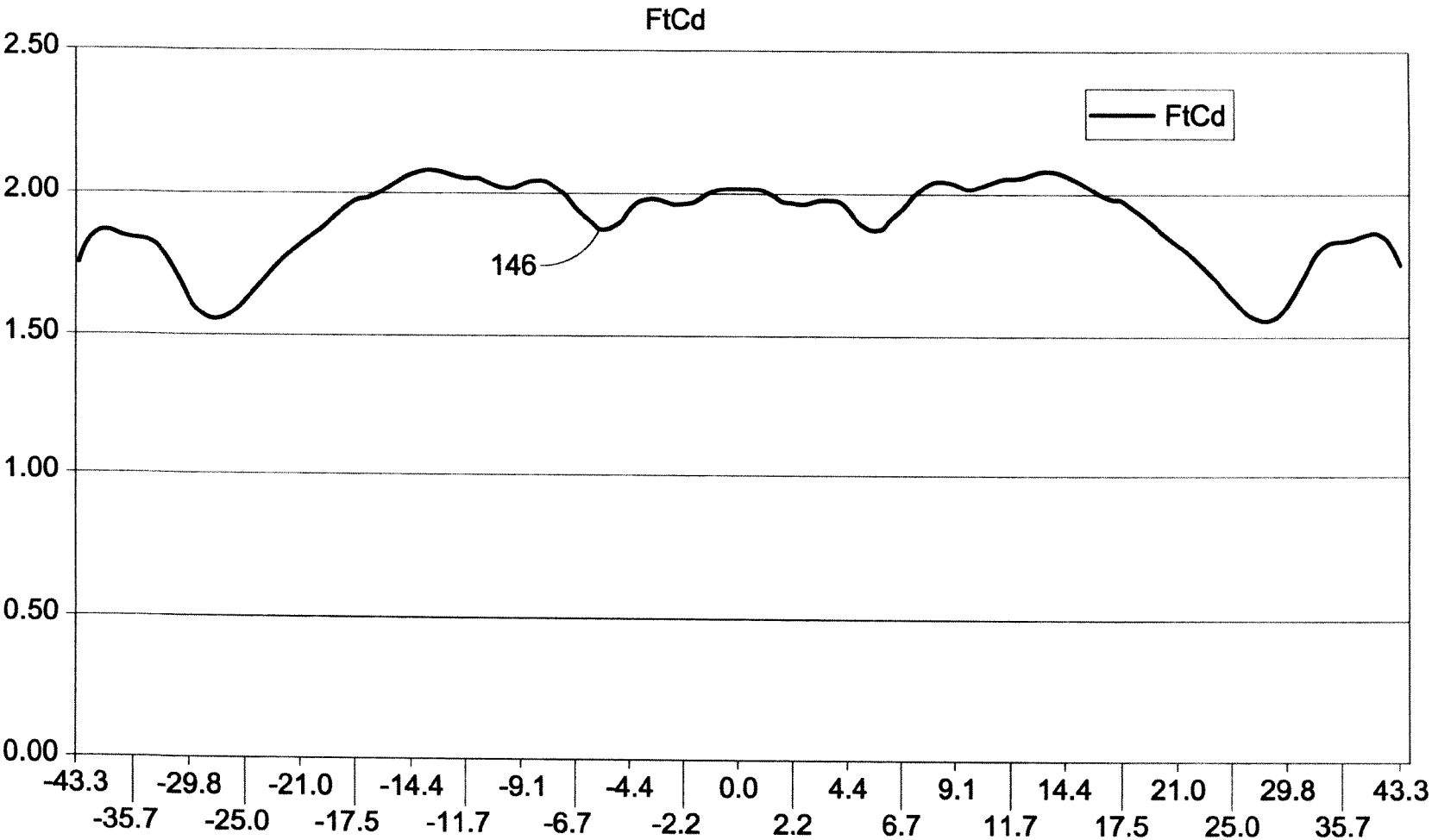
FIG. 9 is a graph showing the illuminance across the target plane generated by the luminaire shown in FIG. 1.

FIG. 9 shows illumination across a target plane at line 146 which measures foot candles across a target plane where the luminaire is disposed 25 feet (or meters) above the target plane. As can be seen in FIG. 9, the distribution across the target plane is generally uniform illumination across the target plane.

With reference back to FIG. 3, the fixture housing is typically made of metal and includes a plurality of fins 150 that provide a heat dissipating function for the luminaire. The fixture housing 12 also includes a circular recess, which can take alternative configurations, to receive the reflector/PCB assembly 14. The reflector housing also includes a passage 154 that leads to an electrical panel recess 156. The electrical panel recess receives power conditioning electronics (not shown) that can condition line voltage to provide the appropriate current and voltage to the LEDs of the reflector/PCB assembly 14. An electrical panel cover 158 covers the electrical panel recess 156. A fixture wire pass cover 162 covers the passage 154 between the circular recess 152 and the electrical panel recess 156. Wires (not shown) connecting the PCB 56 to the power conditioning electronics pass through this passage 154. The fixture housing 12 attaches to a mounting bracket 164 to attach to a light pole. A mounting box cover 166 is provided to cover a hollow portion of the mounting bracket which can store wires in other components.

A spherical cover 170 attaches to the fixture housing 12 to cover the reflector/PCB assembly 14. A retaining ring 172 is used to affix the electrical cover 170 to the fixture housing 12. The spherical cover 170 is designed so that light is neither reflected nor refracted as it passes through the spherical cover 170. Accordingly, in this instance the cover 170 has a spherical shape to accommodate the polar angles at which light is being emitted from the reflector/PCB assembly 14.

As mentioned above, the design for the luminaire 10 is scalable. Moreover, the luminaire can be slightly reconfigured to utilize refractive optics instead of reflective optics. In such an instance, lenses, which would be circular if a circular beam pattern were desired, would be provided over the rings of LEDs to refract the light towards the desired angle. If a narrower beam pattern is desired, the optics, whether it be a reflective or refractive optics, can be configured to direct the light at angles that are greater than 60° or less than 60°. The embodiment shown and described is one specific example of a luminaire that can provide a general uniform illumination across a target plane.

Figure 10:
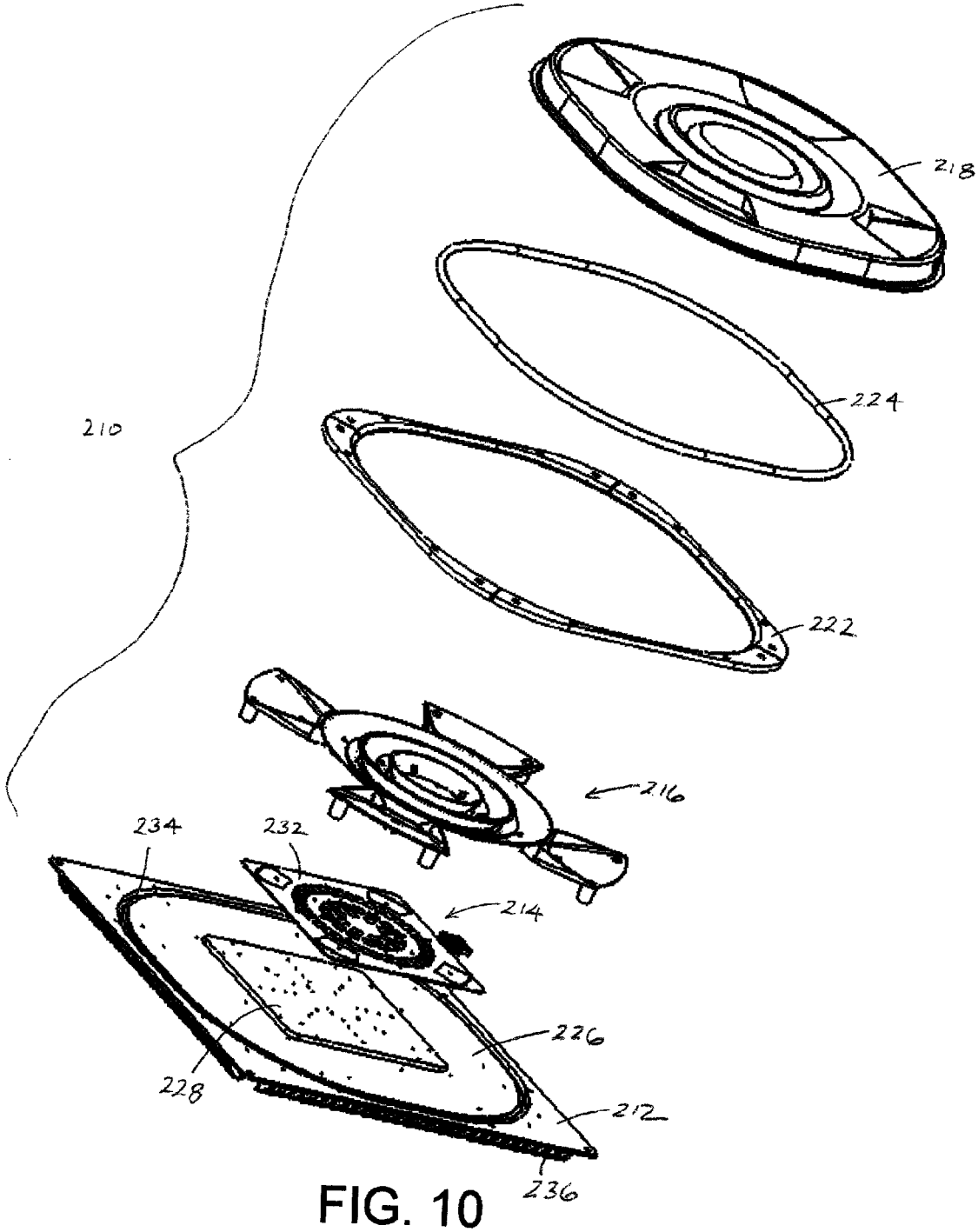
FIG. 10 is an exploded view of an alternative embodiment of a luminaire that generates substantially uniform illumination across a target surface.

With reference to FIG. 10 an alternative embodiment of a luminaire is disclosed. The luminaire 210 includes a heat sink 212, a printed circuit board ("PCB") assembly 214, at least one reflector 216, and a lens 218 that covers PCB assembly 214 and the at least one reflector 216. A lens retainer 222 fixes the lens 218 to the heat sink 212. A gasket 224 is sandwiched between the lens 218 and the heat sink 212 when the lens retainer 222 is attached to the heat sink.

In the depicted embodiment, the heat sink 212 is aluminum, although other heat conductive materials can be used. Heat is drawn from the printed circuited board assembly 214 into the heat sink 212. The heat sink 212 includes a generally planar base surface 226. The heat sink 212 is formed having a central pedestal 228 that has approximately the same area as a printed circuit board 232 of the PCB assembly 214. The PCB assembly 214 attaches to the heat sink 212 contacting the pedestal 228, which extends slightly above and normal to the planar base surface 226 of the heat sink 212. A channel 234 extends into the heat sink from the planar base surface 226 and surrounds the pedestal 228. The channel 234 is configured to receive the gasket 224. The heat sink 212 also includes a plurality of fins 236 that extend away from and normal to the main planar surface 226.

Figure 11:
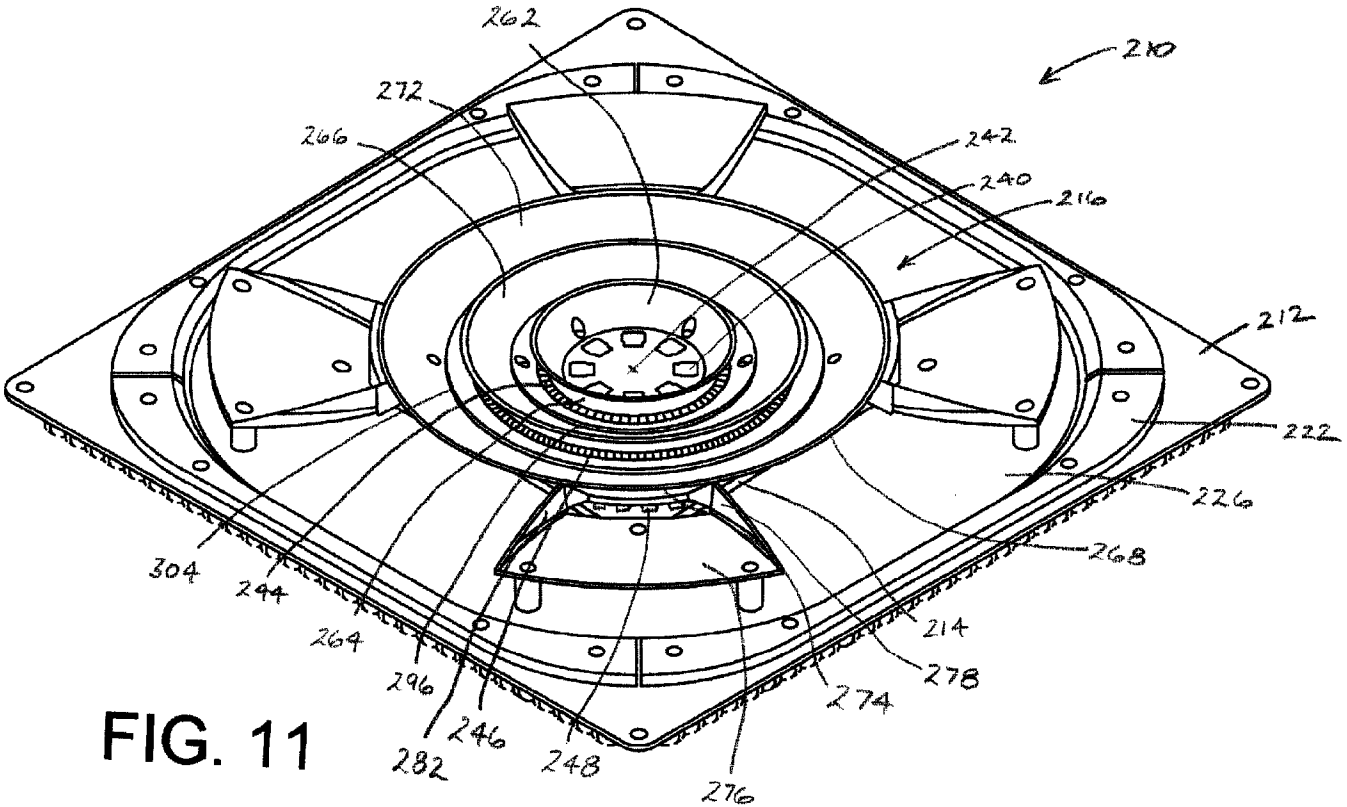
FIG. 11 is a perspective view of the luminaire of FIG. 10 with the lens of the luminaire removed.

With reference to FIGS. 10 and 11, the PCB assembly 214 includes the printed circuit board 232, which acts as a support for a plurality of LEDs. In the depicted embodiment, the LEDs mount on the support (PCB) 232 and face a target plane that is to be illuminated, similar to the embodiment described above. The LEDs emit light toward the target plane; some of the emitted light is redirected by the reflector 216 and some of the light emitted from the LEDs is allowed to escape the luminaire without being redirected.

The luminaire 210 in FIGS. 10-14 is similar to the luminaire 10 described above in that the luminaire 210 includes LED arrays cooperating with an optic to generate a predetermined beam pattern. The luminaire 210 includes rings of LEDs that cooperate with reflective optics to generate a substantially circular beam pattern. In addition, the luminaire includes additional LEDs that cooperate with additional reflective optics to direct light diagonal directions to fill in "corners" around the circular beam pattern to generate a substantially square beam pattern.

An innermost plurality of LEDs 240, hereafter also referred to as the first set of LEDs, have their centers spaced substantially equidistantly from a fixed point 242. An intermediate plurality of LEDs 244, hereafter also referred to as the second set of LEDs, also have their centers spaced substantially equidistantly from the fixed point 242. The second set of LEDs 244 is spaced farther from the fixed point 242 as compared to the first LED set 240. Another intermediate plurality of LEDs 246, hereafter also referred to as the third set, have their centers spaced substantially equidistantly from the fixed point 242. The third set of LEDs 246 is spaced farther from the fixed point 242 as compared to the second LED set 244. The first set of LEDs 240, the second set of LEDs 244 and the third set of LEDs 246 can form a central array of LEDs disposed on a mounting surface, e.g. PCB 232, to generate a first beam pattern, which in the depicted embodiment will be generally circular, on the target plane.

A fourth plurality of LEDs 248, hereafter also referred to as the fourth set, have their respective centers each being spaced substantially equidistantly from the fixed point 242. The fourth set of LEDs 248, which can also be referred to as a peripheral array of LEDs, is spaced farther from the fixed point 242 as compared to the third LED set 246.

In the depicted embodiment, the LED sets 240, 244, 246 and 248 form rings around the fixed point 242. These rings can also be multi-sided regular polygons. Where the inscribed circle of the regular polygon begins to approximate the same radius as the circumscribed circle for the regular polygon, the LED set begins to more closely approximate a circle.

In the depicted embodiment, the fourth plurality of LEDs 248 is a truncated ring in that the LEDs follow only a portion of an arc of a circle having its center at the fixed point 242. More particularly, the fourth LED set 248 is divided into four subsets that will illuminate the corners of a square shaped beam pattern. The fourth set of LEDs 248 can also approximate a truncated regular polygon.

The LEDs in each of the sets face the target plane to emit direct light towards the target plane. An electrical connector 252 attaches to the printed circuit board 232 and also to an electrical wire (not shown) to provide electricity to the LEDs.

The reflector 216 in the depicted embodiment includes a plurality of reflective surfaces that cooperate with the LEDs to direct light from the LEDs towards the target plane. The reflector 216 is a molded integral plastic piece having metalized reflective surfaces. Alternatively, the reflector can be a multi-piece metal assembly or a cast metal piece, for example.

Figure 12:
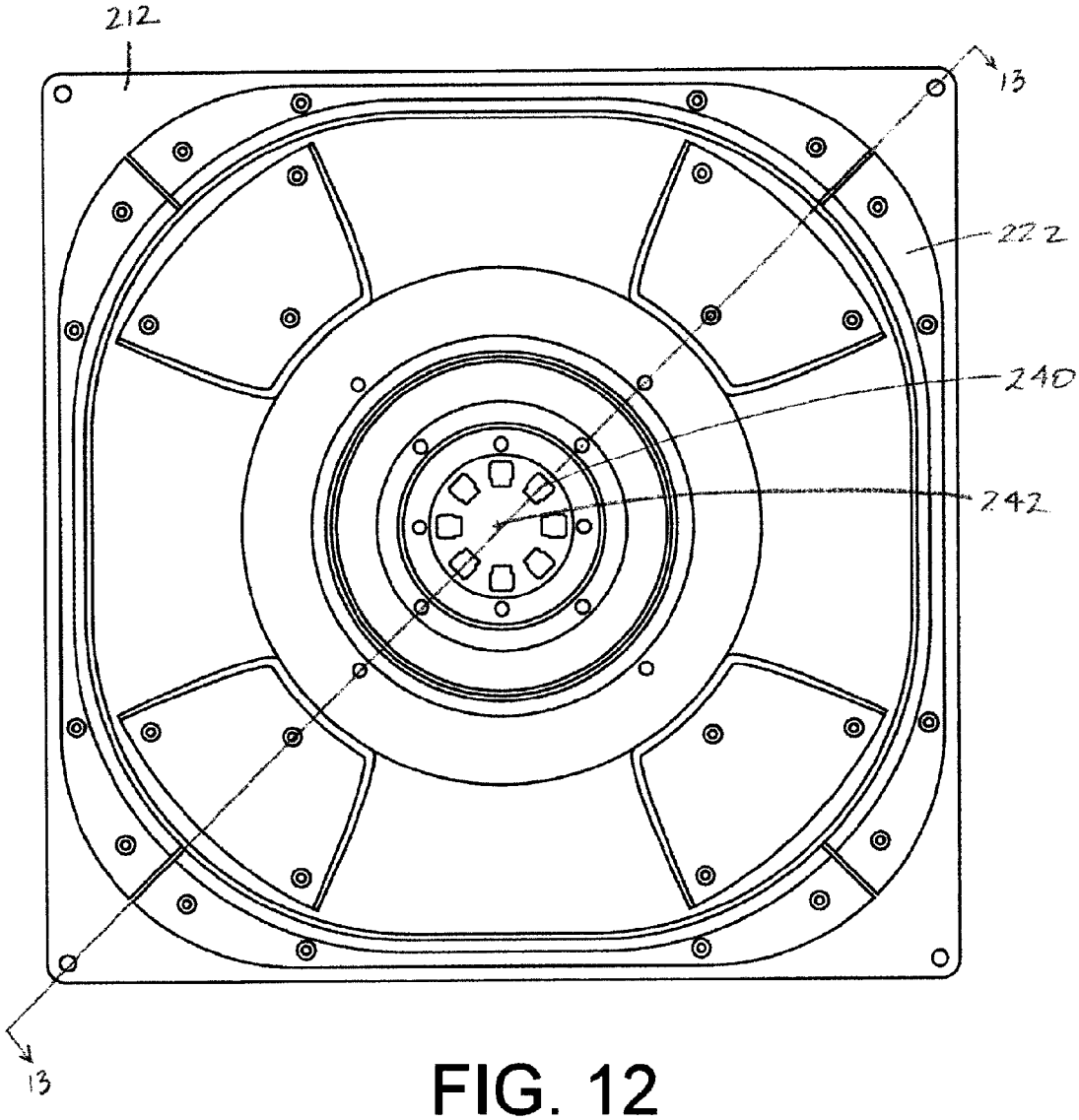
FIG. 12 is a plan view of the luminaire of FIG. 10 with the lens removed.
Figure 13:
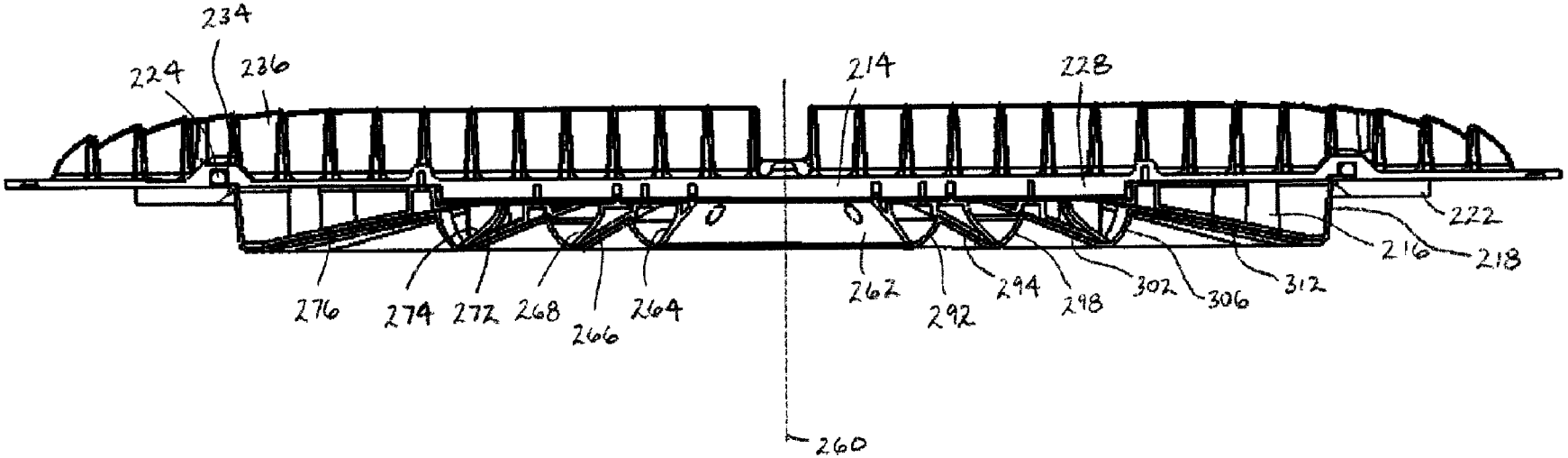
FIG. 13 is a cross-sectional view taken along line 13-13 in FIG. 12, but the lens is attached to the heat sink.
Figure 14:
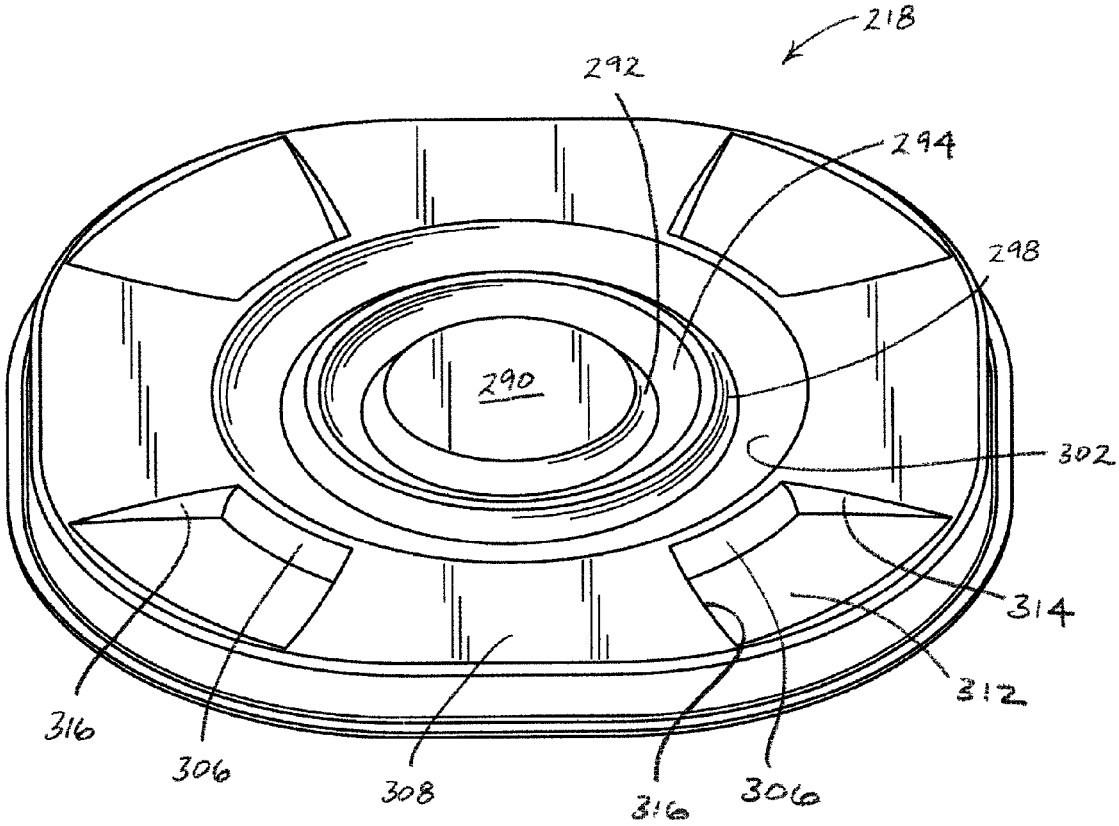
FIG. 14 is a perspective view of the lens of the luminaire depicted in FIG. 10.

With reference to the embodiment depicted in FIGS. 12 and 13, each reflective surface of the at least one reflector 216 is a surface of revolution with respect to a line 260 that intersects the fixed point 242 and is normal to the plane in which the LEDs reside, which in the depicted embodiment makes the line normal to the PCB 232. A first (innermost) reflective surface 262 cooperates with the first set of LEDs 240. A second reflective surface 264 and a third reflective surface 266 cooperate with the second plurality of LEDs 244. A fourth reflective surface 268 and a fifth reflective surface 272 cooperate with the third plurality of LEDs 246. A sixth reflective surface 274 and a seventh reflective surface 276 cooperate with the fourth plurality of LEDs 248. The sixth reflective surface 274 and the seventh reflective surface 276 differ from the first five reflective surfaces because these surfaces are truncated by planes emanating from the axial line 260 and perpendicular to the plane in which the LEDs reside. Accordingly, the sixth reflective surface 274 and the seventh reflective surface 276 are divided into four subsets.

In the depicted embodiment, the sixth reflective surface 274 and the seventh reflective surface 276 are divided into four separate surfaces that each follow the arc of a circle having its center at the fixed point 242. Additional side, generally radially aligned, reflective surfaces 278 and 282 (see FIG. 11) can cooperate with the fourth plurality of LEDs 248 to limit light emission in a direction blocked by the respective reflective surfaces 278 and 282.

The LED sets 240, 244 and 246 and the reflective surfaces 262, 264, 266, 268 and 272 radially inward from the sixth reflective surface 274 generate a generally circular beam pattern on a target plane that is vertically spaced from and generally normal to the axis 260. The fourth LED set 248 and the sixth reflective surface 274 and the seventh reflective surface 276 along with the side reflective surfaces 278 and 282 that are associated with the fourth LED set 248 cooperate with one another to generate a truncated annular beam pattern on the target plane. This allows the beam pattern that is generated by this luminaire 210 to approximate a square. The fourth LED set 248 and the sixth reflective surface 274, the seventh reflective surface 276, and the respective side surfaces 278 and 282 direct the light diagonally toward the corners of the square shaped beam pattern. The fourth LED set 248 and the sixth reflective surface 274, the seventh reflective surface 276, and the respective side surfaces 278 and 282 form a plurality of, more particularly four, peripheral arrays of LEDs disposed on the mounting surface of the PCB around the central array to generate an additional beam pattern that when combined with the beam pattern from the central array generate a square, or rectangular, shaped beam pattern.

In the depicted embodiment, the reflective surfaces form rings around the fixed point 242. Similar to the LED sets, these rings can also be multi-sided regular polygons. Where the inscribed circle of the regular polygon begins to approximate the same radius as the circumscribed circle for the regular polygon, the LED set begins to more closely approximate a circle.

One manner of providing a beam pattern having a substantially constant illuminance across a target plane is to begin by designing a first LED array, which in the depicted embodiment can include LED sets 240, 244 and 246, and at least one optic, e.g. reflective surfaces 262, 264, 266, 268 and 272, to generate a first beam pattern, e.g. circular, on the target plane. Knowing the pole height and the desired planar surface area that is to be illuminated, the required intensity distribution can be plotted based on the known function $E=I\cos^3\Theta/h^2$, where E is illumination (lumen/ft$^2$ or lumen/m$^2$), and I is the luminous intensity (cd). The required intensity distribution for the inscribed circle of a square shaped beam pattern is shown at line 330 in FIG. 15.

The third set of LEDs 246, which is the outermost ring of the array that generates a circular beam pattern, cooperates with fourth reflective surface 268 and the fifth reflective surface 272 to direct at least a majority of the luminous intensity from the third LED set 246 toward the target plane at an angle of incidence that is based on the design parameters (for example the desired illuminance) for the target plane. More particularly, a peak of the luminous intensity of light from the third set of LEDs 246 (see line 332 in FIG. 14) is directed at an angle of incidence that is a function of the height that the luminaire 210 is spaced from the target plane and the surface area to be illuminated by the luminaire. Since illuminance on the target plane varies as the cosine of the angle of incidence, and illumination at a point on the target plane varies directly with the luminous intensity of the source, and inversely as the square of the distance between the source and the point on the target plane, a majority (and a peak) of the luminous intensity from the third set LEDs 246 is directed at a higher angle of incidence as compared to the first LED set 240 and the second LED set 244. This is accomplished in the similar manner as described with reference to the luminaire 10, which has been described above. The fourth reflective surface 268 and the fifth reflective surface 272 have a conic section configuration shaped to direct light from the third set of LEDs 246 at the desired angle of incidence as measured inside from the pole axis PA (see FIG. 4) of the pole to which the luminaire 210 will mount (this would be the vertical axis normal to the floor and intersecting the axis 260 if the luminaire is mounted to the ceiling of a building). The fourth reflective surface 268 and the fifth reflective surface 272 are also spaced from one another to allow light from the third set of LEDs 246 to escape through this annular opening at a desired angle of incidence. Accordingly, the annular beam pattern generated by the third LED set 246 is a combination of direct light from the LEDs, which can be at multiple angles of incidence for LEDs the emit a Lambertian pattern, and reflected light from the third set of LEDs 246.

The desired angle(s) of incidence for light emanating from the third LED set 246 is a function of the height at which the luminaire 210 is spaced from the target plane (h) and the desired planar surface area that is to be illuminated by the luminaire based on the known function $E=I\cos^3\Theta/h^2$, where E is illumination (lumen/ft$^2$ or lumen/m$^2$), and I is the luminous intensity (cd) of the total number of LEDs in the third set 246. The maximum angle of incidence $\Theta$ for the third LED set 246 is based on the surface area of the target plane and can be found by $\tan\Theta=r/h$, where r is the radius of the circle for a circular pattern or the radius of the inscribed circle for a square pattern. Modeling can be performed to provide the desired illumination around the periphery of the circular target plane having the radius r, or the square target plane having the inscribed circular radius of r.

The second set of LEDs 244, which is the intermediate ring of the central array, cooperates with the second reflective surface 264 and the third reflective surface 266 to direct at least a majority (and a peak—see line 334 on FIG. 15) of the luminous intensity from the second LED set 244 toward the target plane at an angle of incidence that will typically be less than the angle of incidence for the third LED set 246. Since the second LED set 244 is formed in a ring or a regular polygon that is smaller than the third LED set 246, fewer LEDs will typically be located in the second LED set 244 as compared to the third LED set 246. This will result in a smaller luminous intensity being emitted from the second LED set 244 as compared to the third LED set 246. The design of the second set of LEDs 244 and the reflective surfaces 264 and 266 that cooperate with the second set of LEDs is also based on $E=I\cos^3\Theta/h^2$. Since illumination on the target plane varies inversely as the square of the distance between the source and a point of the target plane, the second set of LEDs 244 cooperates with the second reflective surface 264 and the third reflective surface 266 to direct this luminous intensity at an angle of incidence less than the angle of incidence for the third LED set 246 because the luminous intensity required to provide the desired illumination at this location on the target plane TP (see FIG. 4) is less.

Figure 15:
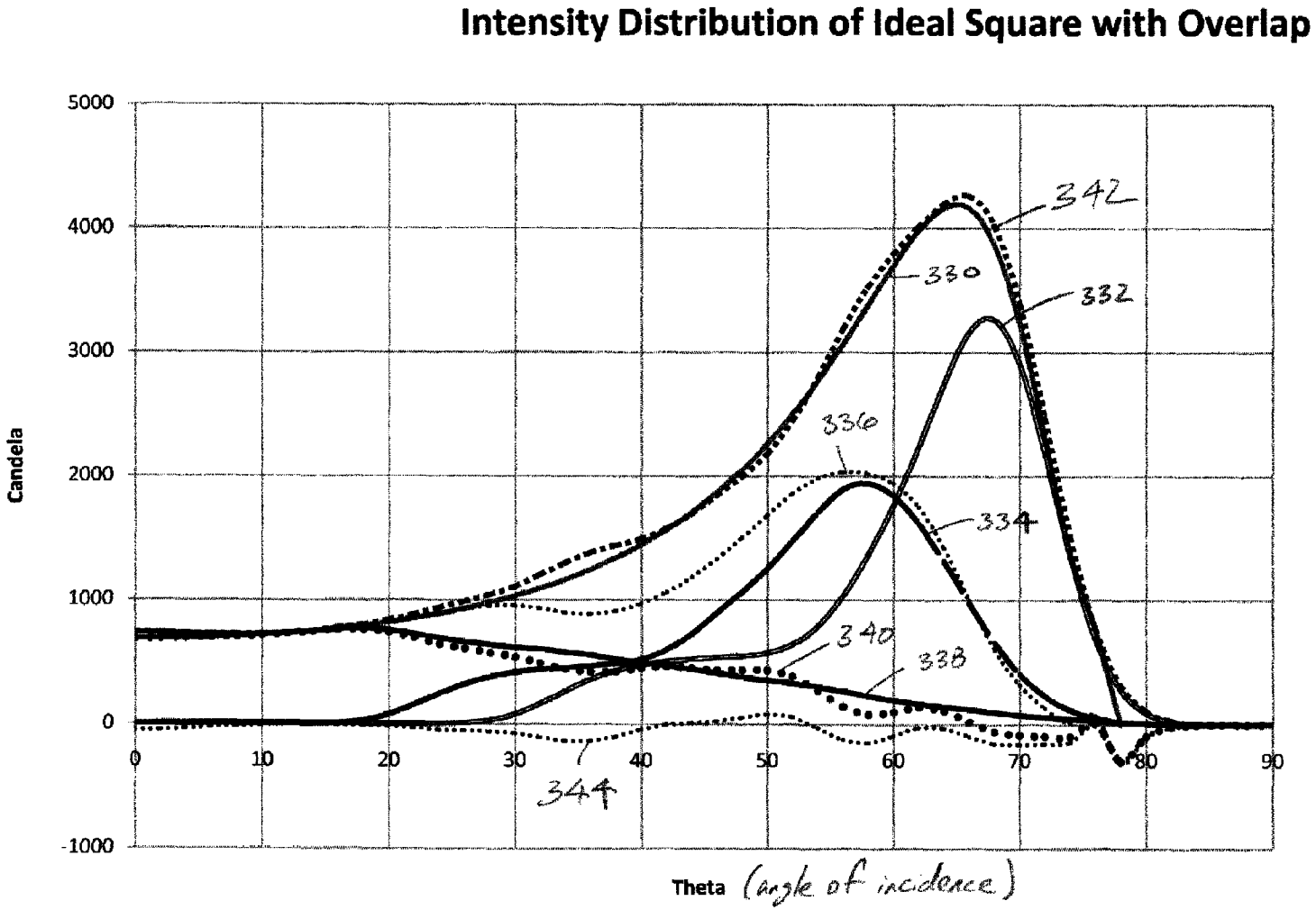
FIG. 15 is a graph showing the luminous intensity being generated from different LED sets of the luminaire of FIG. 10 at different angles of incidence.

The second reflective surface 264 and the third reflective surface 266 have a conic section shaped configured to redirect light from the second set of LEDs 246 at a desired angle as measured inside from the pole axis of the pole to which the luminaire will mount. The desired incident angle for light emanating from the second LED set 246 is a function of the height at which the luminaire is spaced from the target plane (h) and the desired planar surface area that is to be illuminated by the luminaire 210 taking into account the light that is impinging on the target plane from the third LED set 246. Line 336 on FIG. 15 depicts the difference between the luminous intensity from the third LED set 246 and the luminous intensity from the second LED set 244. Line 340 depicts light intensity from the third ring set and the second ring set 244 less the light intensity from the first ring set 240.

The first set of LEDs 240 provide a majority of light that lands directly vertically below the fixture. Light intensity from the first LED set is depicted at line 338 The first reflective surface 262 cooperates with the first LED set 240 to provide the desired illumination directly below, or nearly directly below (or above if the luminaire were used to illuminate a ceiling for example) the luminaire.

As can be seen in FIG. 15, the combination of light intensity from the LED ring sets 240, 244 and 246 cooperating with the respective reflective surfaces (optics) results in a desired beam pattern (represented by line 342) that closely approximates the candela at different angles of incidence required to generate a substantially uniform illuminance across the target plane. This can be seen in line 344 which is the difference between the required candelas at different angles of incidence (line 330) and the combination of luminous intensity generated from the LED rings 342.

As discussed above, the luminaire 210 is designed to generate a substantially square pattern on the target plane. In the depicted embodiment, the fourth set of LEDs 248 cooperating with the sixth reflective surface 274 and the seventh reflective surface 276 are configured to direct light toward the corners of the square shaped pattern. This being the case, the fourth set of LEDs 248 cooperate with the sixth reflective surface 274 and the seventh reflective surface 276 to direct light at an incident angle that is greater than the third LED set 246. Again, the desired incident angle for light emanating from the fourth LED set 246 is a function of the height at which the luminaire is spaced from the target plane (h) and the desired planar surface area that is to be illuminated by the luminaire. The incident angle for the fourth LED set 248 is greater than the incident angle for the third LED set 246 because the luminous intensity from the fourth LED set 248 is directed towards the radius for the circle that circumscribes the generally square pattern of the target plane. The same design for the inscribed circular area for the square shaped pattern can be followed to light the corner areas of the square pattern.

Light intensity directed towards the corners of the square shaped pattern is accounted for in a similar manner to the inscribed circle of the square pattern. The light intensity required by the fourth set of LEDs 248 is dependent upon the intensity distribution from the central array of LEDs, i.e. LED sets 240, 244 and 246, subtracted from the required intensity distribution for uniform illuminance in the diagonal direction of the substantially square shaped beam pattern. The fourth LED set 248 and the respective reflective surfaces 274 and 276 are truncated so that the beam pattern is not completely circular, which would direct too much light beyond the square shaped pattern.

The space between the reflective surfaces in the depicted embodiment, which is an annular space with respect to the fixed point 260, determines the amount of direct light that impinges upon the target plane. This can be modified as desired. For example, one of the reflective surfaces that cooperates with each ring of LEDs can be removed. In the depicted embodiment, the height that the reflective surfaces extend normally from the plane in which the LEDs reside is the same for each reflective surface.

The lens 218 cooperates with the LEDs to allow the LEDs to generate the desired beam pattern. The lens 218 has a much lower profile as compared to the lens 170 in the embodiment described above. The lens 218 includes a central circular planar section 290 that cooperates with the first set of LEDs 240. The central section 290 is shaped so that light from the first set of LEDs 240, both direct and reflected light, passes through the central section with little or no refraction.

The lens 218 also includes a first (innermost) annular section 292 that generally follows a surface of revolution (having a small thickness in a generally radial direction) with respect to the central axis 260 of the luminaire 210. The central section 290 transitions into the first annular section 292 where the outermost edge of the first reflective surface 262 and the second reflective surface 264 contact or nearly contact the lens 218 (see FIG. 13). The first annular section 292 is curved in cross section taken in a plane in which the central axis 260 resides (see FIG. 13) so that the curve of the first annular section is substantially perpendicular to light rays that reflect off of the second reflective surface 264 from the second set of LEDs 244.

Going radially outwardly the first annular section 292 transitions into a second annular 294 that follows the contour of the third reflective surface 266. Accordingly, the second annular section 294 also follows a surface of revolution (having a small thickness) with respect to the central axis 260 of the luminaire. Since the second annular section 294 follows the contour of the third reflective surface 266, the second annular section is perpendicular to light rays that reflect off of the third reflective surface 266 from the second set of LEDs 244. As more clearly seen in FIG. 11, a circular ridge 296 is formed in the reflector 216 in the third reflective surface 266 to receive the lens 218 where the lens transitions from the first annular section 292 to the second annular section 294. The ridge 296 allows the second annular section 294 to closely conform to the third reflective surface 266.

The second annular section 294 transitions into the third annular section 298 where the outermost edge of the third reflective surface 266 and the fourth reflective surface 268 meet and contact or nearly contact the lens 218 (see FIG. 13). The third annular section 298 is curved in cross section (see FIG. 13) so that the curve of the third annular section is substantially perpendicular to light rays that reflect off of the fourth reflective surface 268 from the third set of LEDs 246. The third annular section 298 follows a surface of revolution (having a small thickness) with respect to the central axis 260 of the luminaire.

The third annular section 298 transitions going radially outwardly into a fourth annular section 302 that follows the contour of the fifth reflective surface 272. Accordingly, the fourth annular section 302 also follows a surface of revolution (having a small thickness) with respect to the central axis 260 of the luminaire. Since the fourth annular section 302 follows the contour of the fifth reflective surface 272, the fourth annular section is perpendicular to light rays that reflect off of the fifth reflective surface 272 from the third set of LEDs 246. As more clearly seen in FIG. 11, a circular ridge 304 is formed in the reflector 216 on the fifth reflective surface 272 to receive the lens 218 where the lens transitions from the third annular section 298 to the fourth annular section 302. The ridge 304 allows the fourth annular section to closely conform to the fifth reflective surface 272.

The fourth annular section 302 transitions into curved outer truncated annular (fifth) sections 306 and planar outer sections 308 where the outermost edge of the fifth reflective surface 272 and the sixth reflective surface 274 meet and contact or nearly contact the lens 218 (see FIG. 13). The curved outer truncated annular sections 306 are interrupted by the planar outer sections 308 in a circumferential (rotational) direction with respect to the central axis 260 of the luminaire. The fifth annular section 306 is curved in cross section (see FIG. 13) so that the curve of the fifth annular section is substantially perpendicular to light rays that reflect off of the sixth reflective surface 274 from the fourth set of LEDs 248. The fifth annular section 306 follows a surface of revolution (having a small thickness) with respect to the central axis 260 of the luminaire, although the surface of revolution is truncated by planes that emanate from the central axis 260 and are perpendicular to the plane in which the LEDs reside.

The fifth annular section 306 transitions going radially outwardly into a sixth annular section 312 that follows the contour of the seventh reflective surface 276. Accordingly, the sixth annular section 312 also follows a surface of revolution (although truncated and having a small thickness in a radial direction) with respect to the central axis 260 of the luminaire. Since the sixth annular section 312 follows the contour of the seventh reflective surface 276, the sixth annular section is perpendicular to light rays that reflect off of the seventh reflective surface 276 from the fourth set of LEDs 248.

Radial sections 314 and 316 interconnect the fifth annular section 306 and the sixth annular section 312. These radial sections follow the contour of the radial reflective surfaces 278 and 282 that interconnect the sixth reflective surface 274 and the seventh reflective surface 276. The lens 218 also includes a skirt portion 320 that is generally perpendicular to the planar outer section 308. The skirt includes openings that can receive a vent and a grommet that receives an electrical conductor to provide electricity to the luminaire 210.

The broad concepts discussed herein will be apparent to those skilled in the art after having read this description. Rather than using an optic for each LED or a macro optic for the entire array, the luminaire described uses a hybrid approach that creates portions of the beam pattern from portions of the LED array. The light is redirected from these portions of the LED array using reflectors that are aimed to purposely fill portions of the beam pattern. The design can be modular to provide a "D" shaped beam pattern, for example, as well as other beam patterns. The invention has been particularly described with reference to one embodiment and alternatives have been discussed. The invention, however, is not limited to only the particular embodiment described or the alternatives described herein. Instead, the invention is broadly defined by the appended claims and the equivalents thereof.

The invention claimed is:

1. A luminaire comprising:

a first plurality of LEDs mounted on a support facing a target plane;

a second plurality of LEDs mounted on the support facing the target plane; and at least one reflector fixed with respect to the support, the at least one reflector including a first reflective surface of revolution with respect to a line intersecting a fixed point cooperating with each of the first LEDs and a second reflective surface of revolution with respect to the line intersecting the fixed point cooperating with each of the second LEDs, the reflective surfaces being configured to direct light emitted from the respective LEDs toward the target plane forming a first and second generallv annular beam pattern, wherein a peak of luminous intensity of light from the first plurality of LEDs is at a first angle of incidence and a peak of luminous intensity of light from the second plurality of LEDs is at a second angle of incidence, which is less than said first angle, and wherein said second anle of incidence is a function of overlap of the first generally annular beam pattern on the second annular beam pattern and a height at which the LEDs reside over the plane to a combined beam pattern including the first generally annular beam pattern and the second generally annular beam pattern having a generally uniform illumination cross at least a majority of the combined beam pattern on the tagret plane.

2. The luminaire of claim 1, wherein the first LEDs are arranged in a circle.

3. The luminaire of claim 1, wherein the second LEDs are arranged along an arc of a circle.

4. The luminaire of claim 3, wherein the second reflective surface of revolution is truncated.

5. The luminaire of claim 1, wherein the at least one reflector includes an additional reflective surface of revolution with respect to the line intersecting the fixed point cooperating with the first LEDs, the additional reflective surface being disposed on an opposite side of the first LEDs as compared to the first reflective surface.

6. The luminaire of claim 1, further comprising a lens covering the LEDs and the at least one reflector, the lens including a first light emitting section corresponding with the first LEDs and a second light emitting section corresponding with the second LEDs, the first light emitting section following a surface of revolution with respect to the line intersecting the fixed point.

7. The luminaire of claim 5, wherein the first light emitting section is normal to a direction at which a light ray from one of the first LEDs reflects off of the first reflective surface.

8. The luminaire of claim 1, wherein respective centers of the first LEDs are each spaced substantially equidistantly from a fixed point a distance d1.

9. The luminaire of claim 8, wherein respective centers of the second LEDs are each spaced substantially equidistantly from the fixed point a distance d2.

10. A luminaire comprising:

a substantially planar PCB;

a first set of LEDs mounted on the PCB along an arc of a first circle having a radius r1;

a second set of LEDs mounted on the PCB along an arc of a second circle having a radius r2, wherein r1 and the first circle is concentric with the second circle about a center point; and at least one reflector fixed with respect to the PCB and including a first reflective surface cooperating with each of the first set of LEDs and a second reflective surface cooperating with each of the second set of LEDs, each of the reflective surfaces being a surface of revolution with respect to an axis intersecting the center point and normal to the PCB, wherein the reflective surfaces are configured to direct light emitted from the respective set of LEDs toward a target plane to form a first and second generally annular beam pattern, wherein a peak of luminous intensity of light from the first LEDs is at a first angle of incidence and a peak of luminous intensity of light the second set of LEDs is at a second angle of incidence, which is less than said first angle, and wherein said second angle of incidence is a function of overlap of the first generally annular beam pattern on the second annular beam pattern and a height at which the LEDs reside over the plane to a combined beam pattern.

11. The luminaire of claim 10, wherein the first set of LEDs reside in the same plane as the second set of LEDs.

12. The luminaire of claim 11 , wherein the first set of LEDs face the same direction as the second set of LEDs.

13. The luminaire of claim 10, wherein the first reflective surface and the second reflective surface terminate in a same plane.

14. The luminaire of claim 10, further comprising a lens covering the LEDs and the at least one reflector, the lens including an outermost planar surface that is generally parallel with PCB.

15. A luminaire comprising:

a first set of LEDs;

a first reflective surface cooperating with the first set of LEDs to direct light from the first set of LEDs to form a first generally annular beam pattern on a target plane, wherein a peak of luminous intensity of light from the first set of LEDs is at a first angle of incidence;

a second set of LEDs; and a second reflective surface cooperating with the second set of LEDs to direct light from the second set of LEDs to form a second generally annular beam pattern on the target plane, wherein a peak of luminous intensity of light from the second set of LEDs is at a second angle of incidence, wherein the first angle of incidence is greater than the second angle of incidence and the second angle of incidence is a function of overlap of the first generally annular beam pattern on the second annular beam pattern and a height at which the LEDs reside over the plane to a combined beam pattern including the first generally annular beam pattern and the second generally annular beam pattern having a generally uniform illumination across at least a majority of the combined beam pattern on the target plane.

16. The luminaire of claim 15, wherein a greater number of LEDs is in the first set of LEDs as compared to the second set of LEDs.

17. The luminaire of claim 16, wherein at least one of the generally annular beam patterns is truncated by a plane normal to the target plane.

18. The luminaire of claim 15, wherein each set of LEDs resides in a plane that is parallel to the target plane.

19. The luminaire of claim 18, wherein each LED in each set of LEDs faces the target plane.

20. The luminaire of claim 19, wherein each LED in the first set of LEDs cooperates with the first reflective surface and each LED in the second set of LEDs cooperates with the second reflective surface.

21. The luminaire of claim 20, further comprising an additional reflective surface cooperating with the first set of LEDs, the additional reflective surface being disposed on an opposite side of the LEDs of the first set of LEDs as compared to the first reflective surface.

22. The luminaire of claim 21, wherein each reflective surface terminates at the same height from the plane in which the LEDs reside.

23. A luminaire for generating substantially uniform illumination on a target surface in a predetermined pattern comprising:

a mounting surface;

a central array of LEDs disposed on the mounting surface, the central array comprising a plurality of LEDs and at least one optic configured to generate a first beam pattern on the target surface;

a plurality of peripheral arrays of LEDs disposed on the mounting surface around the central array, each peripheral array comprising a plurality of LEDs and at least one optic configured to generate a second beam pattern on the target surface;

wherein a combination of the first beam pattern and the second beam pattern form the predetermined pattern, and wherein a maximum luminous intensity generated by the plurality of peripheral arrays of LEDs is greater than a maximum luminous intensity generated by the central array of LEDs.

24. The luminaire of claim 23 further comprising at least four peripheral arrays and the predetermined pattern is substantially rectangular.

25. The luminaire of claim 24, wherein the peripherals arrays are spaced equidistant from one another around the central array and the predetermined pattern is substantially square.

26. The luminaire of claim 23 wherein the first beam pattern is substantially circular.

27. The luminaire of claim 23, wherein the mounting surface is substantially planar.

28. The luminaire of claim 23, wherein the central array of LEDs are configured in ring.

29. The luminaire of claim 28, wherein the at least one optic includes a reflective surface of revolution.

* * * * *